United States Patent [19]

Sabo

[11] Patent Number: 5,070,570

[45] Date of Patent: Dec. 10, 1991

[54] RECONDITIONING TOOL FOR ROTARY FACED BUFFING PAD

[76] Inventor: Gary L. Sabo, 230 E. River St., Spring Lake, Mich. 49456

[21] Appl. No.: 371,984

[22] Filed: Jun. 26, 1989

[51] Int. Cl.[5] ..... A46B 5/02

[52] U.S. Cl. ..... 15/160; 15/143 R; 15/159 R; 51/262 A; 81/177.1; D4/134; D4/138; D8/107; D8/DIG. 7

[58] Field of Search ..... 15/143 R, 154 R, 160, 15/167.1-167.3, 236.01-236.03, 210 R, 236.05; D4/104-113, 137-138, 199, 130, 134; D8/107, DIG. 7, DIG. 10; 16/110 R; 7/167; 81/177.1; 51/262 A

[56] References Cited

U.S. PATENT DOCUMENTS

| | | | |
|---|---|---|---|
| D. 17,015 | 12/1886 | Northall . | |
| D. 58,445 | 7/1921 | Marcellus . | |
| D. 107,228 | 11/1937 | Goodman . | |
| D. 202,613 | 10/1965 | Lion . | |
| D. 227,827 | 7/1973 | Lindbo | D4/132 |
| D. 272,195 | 1/1984 | Colemore-Williams . | |
| D. 303,323 | 9/1989 | Saunders | D4/138 |
| D. 309,379 | 7/1990 | Dawes | D4/138 |
| 382,041 | 5/1888 | Keavy . | |
| 2,589,620 | 3/1952 | Leffel . | |
| 2,716,314 | 8/1955 | Upham . | |
| 3,067,446 | 12/1962 | McGauley | 15/167.1 X |
| 3,418,675 | 12/1968 | Mequiar et al. . | |
| 3,753,269 | 8/1973 | Budman . | |
| 4,109,339 | 8/1978 | Dietrich | 15/143 R X |
| 4,481,689 | 11/1984 | Westmoreland | 15/236.01 |
| 4,794,739 | 1/1989 | Ivanditto . | |

*Primary Examiner*—Harvey C. Hornsby
*Assistant Examiner*—C. Cooley
*Attorney, Agent, or Firm*—Harness, Dickey & Pierce

[57] ABSTRACT

An ergonomically configured tool for controlled reconditioning of rotary faced buffing pads has a handle portion, a reconditioning element portion, and a shaft portion interconnecting the handle portion and reconditioning element portion along a longitudinal axis of the shaft portion. The tool statically engages the surface of a rotary faced buffing pad in order to clean and recondition the pad. The tool also provides for controlled and predictable return motion to a first semi-circular portion of the buffing pad on occasion of travel of the tool with respect to the pad over the pad center line and onto a second semi-circular pad portion not amenable to engagement.

9 Claims, 3 Drawing Sheets

RECONDITIONING TOOL FOR ROTARY FACED BUFFING PAD

BACKGROUND OF THE INVENTION

1. Field of the Invention

The present invention relates to an apparatus for cleaning and reconditioning rotary faced buffing pads loaded with excess polishing compounds.

2. Description of Related Art

Rotary faced buffing pads are necessarily used for buffing and polishing of high luster finishes. As an example, rotary faced buffing pads are commonly used in the automobile polishing and refinishing industry for finish polishing of an automobile. Today rotary faced buffing pads of the foam type, such as that disclosed in U.S. Pat. No. 3,418,675 to Meguiar, are utilized. Such foam pads have been used of choice in recent years because of the finish they provide on the automobile.

The rotary faced buffing pads are commonly utilized with hand held rotary tools, which are generally pneumatically or electrically powered.

During polishing of an automobile finish or other finish a buffing or polishing compound is utilized with the buffing pad to provide the necessary grade of abrasive for polishing of the finish. It has been a problem in the past that during the buffing operation the buffing surface of the buffing pad tends to "load up" with an excess polishing compound to a point where the continued use of the buffing pad detrimentally effects the finished surface by causing buffer or swirl marks in the finish, detracting from its polished appearance. Thus, in order to retain optimum polishing conditions the operator must either provide some method of reconditioning of the buffing pad or replace the buffing pad periodically to provide an appropriate surface on the buffing pad for optimum polishing conditions. While replacement of the buffing pad at regular intervals will produce a suitable solution to the loading up problem, this solution is undesirable because of excessive costs of routinely changing the pads.

It has therefore been a goal of the art to provide an apparatus capable of effectively removing accumulations of buffing or polishing compounds from the surface of rotary faced buffing pads, such as the foam pads which are preferentially utilized today. Existing devices which are used to accomplish this result include, among others, straight-handled wire brushes such as that available at hardware stores.

During cleaning of the rotary faced buffing pad using the wire brush, the operator of the rotary tool holds the tool in front of him with one hand, with the face of the buffing pad facing away from his body. In the other hand, the wire brush is used to engage the surface of the pad, which is loaded up with an accumulated buffing compound, in order to remove the excess compound, thereby reconditioning the surface of the pad.

The operator, in cleaning the pad with the wire brush, must move it radially across at least one semi-circle of the pad while the pad is rotating to ensure complete cleaning of the entire surface of the pad. Due to the tendency of these pads to load up more at the center than at the edges of the pad the operator invariably concentrates much of his effort toward the center of the pad which is to be cleaned. It has been found by the present inventor that such procedure is effective and controllable for dressing the semi-circle of the pad which is amenable to use of the brush, i.e., the semi-circle which generally rotates away from the handle of the brush. However, as the operator progresses radially across the semi-circle he either crosses onto the other semi-circular side of the pad or is pulled onto it by the action of the pad on the brush, which is particularly a problem at the center thereof. When this occurs, it has been found that the forces exerted on the brush are uncontrollable and cause jamming of the brush, generally into or at the operator. This uncontrollable movement is undesirable and may pose a hazard to the operator trying to perform this method. This problem is illustrated, more particularly below, in FIG. 8 and in the following specification.

It, thus, has been a goal in the art to eliminate this tendency of a straight-handled brush to jam directly backward upon occasion of crossing the center line of the buffing pad from a first semi-circular portion and encounter the non-amenable rotational forces of the second semi-circular portion.

Therefore, it is an object of the present invention to provide an ergonomically effective reconditioning tool for controlled reconditioning of rotary faced buffing and polishing pads which will work with the operator's hand and wrist instead of acting in an uncontrollable manner.

It is still further an object of the present invention to provide a cleaning tool capable of controlled return motion to a first semi-circular portion upon occasion of crossing the buffing pad center line and encountering in the second semi-circular portion forces adverse to engagement of the tool with the pad.

SUMMARY OF THE INVENTION

According to the present invention there is provided an ergonomically effective tool for controlled reconditioning of a rotary faced buffing pad by engagement of a portion of the rotary faced buffing pad while it is rotating on a hand held rotary tool. The rotary tool is held by an operator in a first hand such that the face of the buffing pad faces away from the operator. The buffing pad includes a first semi-circular portion which is amenable to engagement by a reconditioning tool and a second semi-circular portion which is not amenable to engagement by a reconditioning tool. The reconditioning tool of the present invention includes a handle and a reconditioning element portion interconnected by a shaft portion having a longitudinal axis. The reconditioning element is provided with means for removing excessive compounds from the surface of rotary faced buffing pads. The handle portion is disposed at a first angular direction with respect to the longitudinal axis of the shaft portion. The reconditioning element portion is disposed in a second angular direction to the longitudinal axis opposite of the first angular direction. The tool of the present invention provides for static engagement of the buffing pad on the first semi-circular side and provides for controlled movement of the reconditioning element back to the first semi-circular portion upon movement of the reconditioning element to the second semi-circular portion of the rotary faced buffing pad.

A method of removing excessive compounds from a buffing pad in a controlled manner is provided. This includes positioning the cleaning tool relative to the rotating surface of the buffing pad and removing from the surface excess compounds. The method of the present invention provides controlled return motion of the tool upon occasion of the tool crossing the center line of the buffing pad onto the second semi-circle of the pad not amenable to engagement.

Additional benefits and advantages of the present invention will become apparent from the subsequent description of the preferred embodiments and the appended claims taken in conjunction with the accompanying drawings.

DESCRIPTION OF THE PREFERRED EMBODIMENT

Figure 1:
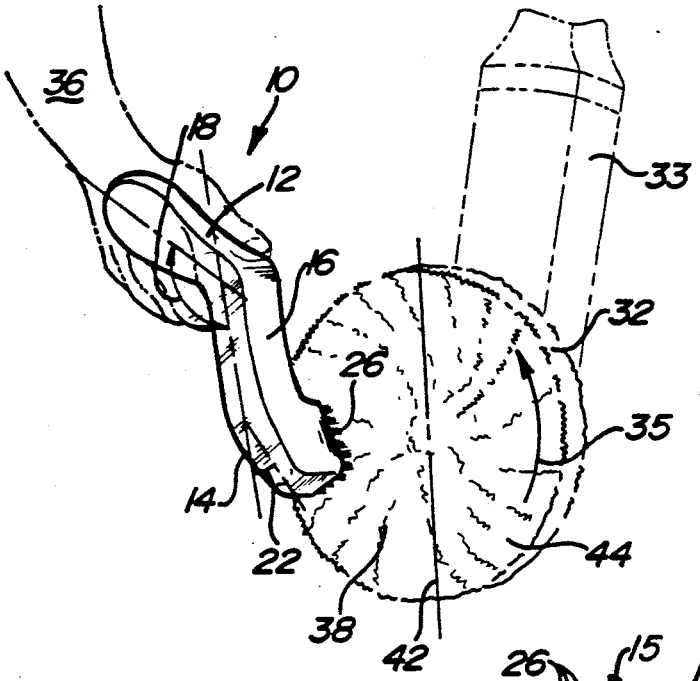
FIG. 1 is an overall perspective view of the reconditioning tool of the present invention in its operational environment.
Figure 2:
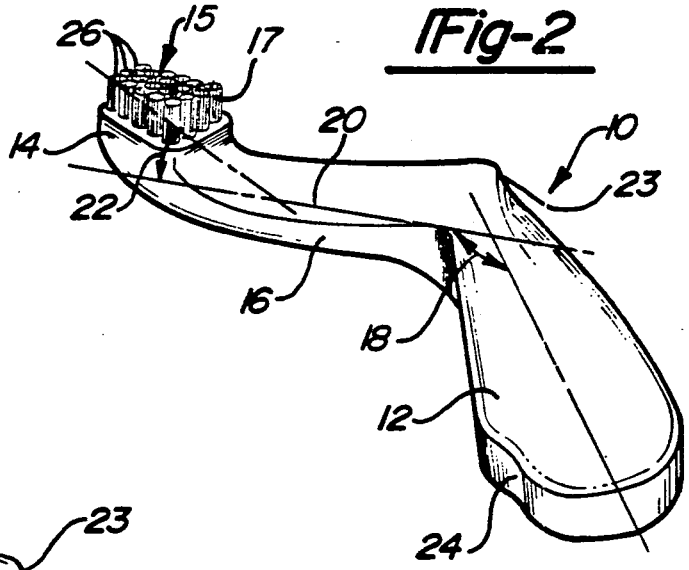
FIG. 2 is a perspective view of the bottom portion of the reconditioning tool of the present invention.
Figure 3:
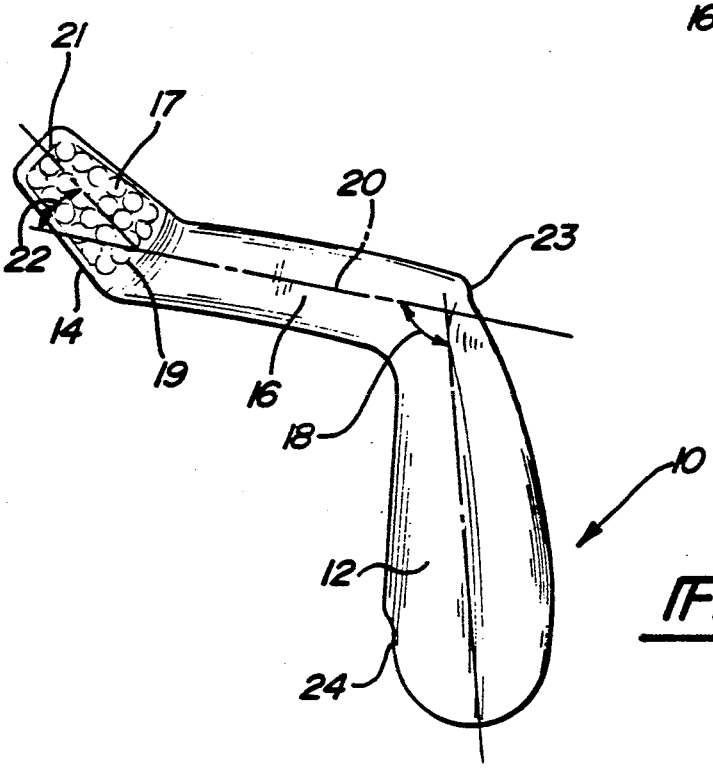
FIG. 3 is a bottom elevational view of the reconditioning tool of the present invention.

Referring to FIG. 1 there is provided an ergonomically effective tool 10 for controlled reconditioning of a rotary faced buffing pad 32. The buffing pad 32 is rotated in a hand held rotary tool 33 of the type (pneumatically or electrically driven) which are commonly used for polishing of an automobile for instance. The rotary tool 33 is held in a first hand (not shown) of the operator such that the buffing face of the buffing pad faces away from the operator. It has been discovered by the inventor herein that with the brush rotating in a first direction, as shown by arrow 35, an imaginary diametrical line 42 may be extrapolated which separates the face of the buffing pad 32 into a first semi-circular portion 38 and a second semi-circular portion 44. The first semi-circular portion 38 is amenable to engagement by a variety of tools for cleaning and/or reconditioning of the pad. However, as explained above, the engagement of the first semi-circular portion 38 with a tool may tend to pull the tool onto the second semi-circular portion 44 or the operator may tend to cross over line 42 onto the second semi-circular portion 44 during movement of the tool along the buffing pad 32. The second semi-circular portion 44 of the pad 32 is not amenable to contact with a tool such as those used in the past and creates uncontrollable movement of prior art tools when passing onto this side of the pad. The present invention remedies this problem as set forth below.

Referring to FIGS. 1, 2, 3 and 7 a rotary faced buffing pad reconditioning tool shown at 10 is provided. The reconditioning tool of the present invention includes a handle portion 12, a reconditioning element portion 14, and a shaft portion 16. The shaft portion 16 is generally aligned along a central longitudinal axis 20. The handle portion 12 is disposed at a first angular direction as shown at angle 18 with respect to the longitudinal axis 20 of the shaft portion 16. The reconditioning element portion 14 is disposed in a second angular direction as shown by angle 22 opposite to the first angular direction 18.

In the present invention the reconditioning element 14 is disposed with respect to the handle portion 12 in such a manner that the rotational moment transferred to the operator is reduced enough to allow the operator to remain in control of the reconditioning tool while the tool is in contact with the pad, even if the tool inadvertently contacts the second semi-circular portion of the pad surface. Additionally, the angular orientation of the elements is ergonomically effective such that when the reconditioning element does cross over onto the second semi-circular side of the pad, the tool acts in concert with the natural side to side breaking motion allowed by the wrist which causes the brush to seek its way back the first side of the buffing pad, in a more natural motion for the user.

Generally, the above advantageous properties are provided in a reconditioning tool wherein the angle 18 between the handle portion 12 and the shaft portion 16 is from about 95° to about 140° and the angle 22 between the reconditioning element portion 14 and the shaft portion 16 is from about 15° to about 60°. Typically, the angle 18 is from about 100° to about 110° and angle 22 is from about 30° to about 40° degrees. In a preferred embodiment of the invention, angle 18 is about 100° and angle 22 is about 35°.

The reconditioning element portion 14 includes engagement portion 15 for engagement of the rotary faced buffing pad to provide reconditioning thereof usually by break up and removal of the polishing compound which has loaded up in the pores of the buffing pad. Preferably, engagement portion 15 is a brush element having bristles 17 which provide the necessary engagement. In a preferred embodiment of the rear portion of the bristle, surface 19 is wider than the front portion 21 to form a trapezoidal engagement configuration.

While a bristle-type arrangement for use as an engagement portion 15 is preferred, other surfaces may be provided which would accomplish reconditioning of the buffing pad. For instance, solid structure forming an edge or multiple edge or a comb type structure could be suitable as a reconditioning element without deviating from the teachings of the present invention provided that the structure does not impede upon the operational function of the tool as described herein.

Preferably, a plurality of bristle portions 26 of plastic/nylon composition are utilized. However, bristle portions 26 can also be composed of a metallic or other material. Nylon is preferable since it has less of a tendency to ruin the finish, should a bristle break off and become lodged in the buffing pad.

Figure 4:
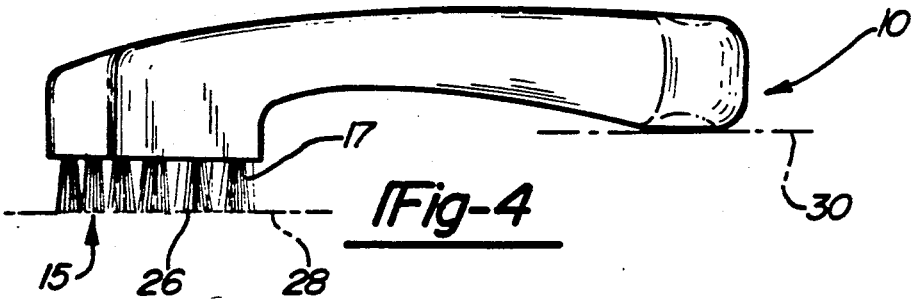
FIG. 4 is a side elevational view of the reconditioning tool of the intermediate arm of the present invention.
Figure 5:
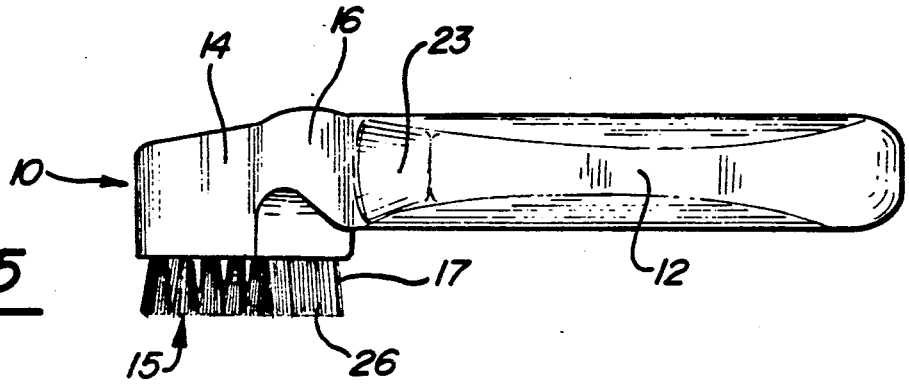
FIG. 5 is a side elevational view displaying the rear handle of the reconditioning tool of the present invention.
Figure 6:
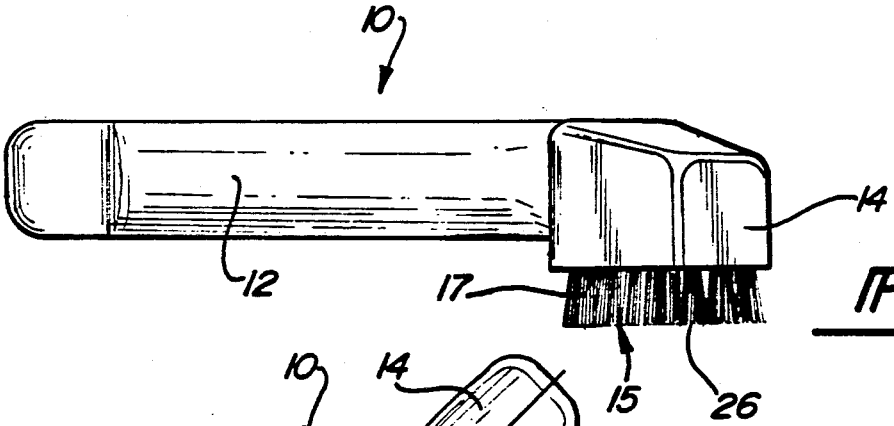
FIG. 6 is a side elevational view of the reconditioning tool of the present invention showing the brush portion.
Figure 7:
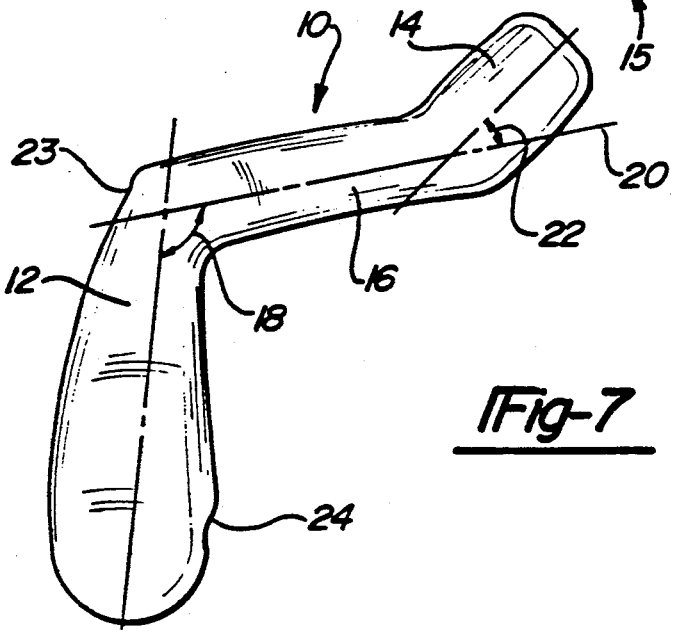
FIG. 7 is a top elevational view of the reconditioning tool of the present invention.

Referring to FIGS. 4, 5 and 6, the planar surface 28 formed by the edges of the bristle portions 26, as indicated, is lower than the planar surface 30 formed by the handle portion 12. The primary advantage of this planar offset is in affording the user a factor of distance between the knuckles of the hand and the fingers and the surface of the rotary buffing pad during reconditioning thereof. This helps guard against injury to the hand or abrasive removal of human skin.

In a preferred embodiment of the present invention the width of the surface of the reconditioning element portion is less than a radial distance of the buffing pad.

Thus, the reconditioning element is effectively moved along the pad from the outer portion of the first semi-circular side of the pad toward the second semi-circular side of the pad 44.

The embodiment of the present invention as shown in the drawings is a right-handed tool used in conjunction with the counter-clockwise rotating buffing pad. However, the concept would be equally applicable to a clockwise rotating buffing pad and a similarly designed left-handed tool.

The handle portion 12 is also ergonomically designed to help ensure proper placement in the hand of the individual for use of the reconditioning tool. In this regard the handle portion 12 includes a thumb rest portion 23 and a "rear" finger indentation 24 on the opposite side thereof. In operation, these rests provide for proper placement in the hand of the operator, since failing to hold the handle in the manner shown will feel awkward to the user.

The invention may also be advantageously used to provide controlled removal of portions of a rotary faced buffing pad so as to re-establish a uniform pad surface. This benefit is particularly applicable, where foam-type pads are utilized and misalignment occurs due to shifting of the surface pad from the underlying "velcro" type attaching material. This reconditioning aspect is also useful in repairing foam pads that have experienced damage due to contact with trim moldings or from uneven wear due to buffing and polishing applications.

It has been a problem that when attaching velcro buffing pads to the backing substrate it is hard to correctly center them. The tool of the present invention can be used to remove part of the foam about the edges of the pad by applying excess pressure at the circumferential edge to remove unwanted material for rounding out of the pad.

Figure 8:
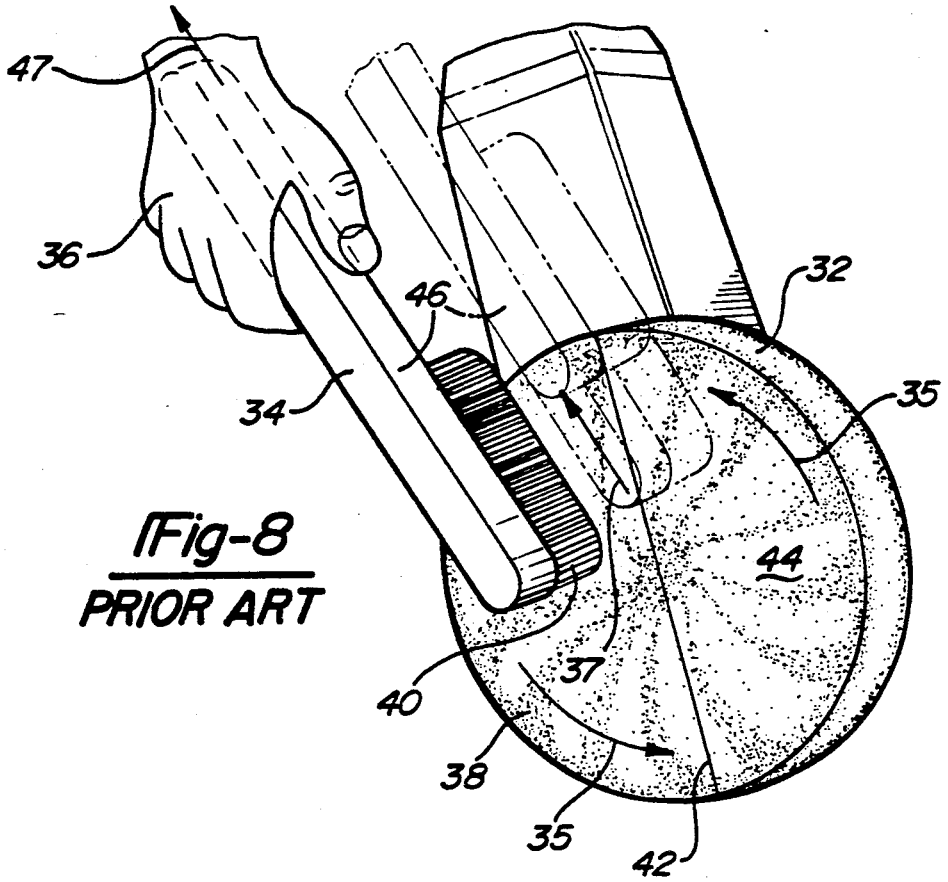
Fig-8 PRIOR ART
FIG. 8 is an overall perspective view of a prior art straight-handled brush showing its use in reconditioning of a buffing pad.
Figure 9:
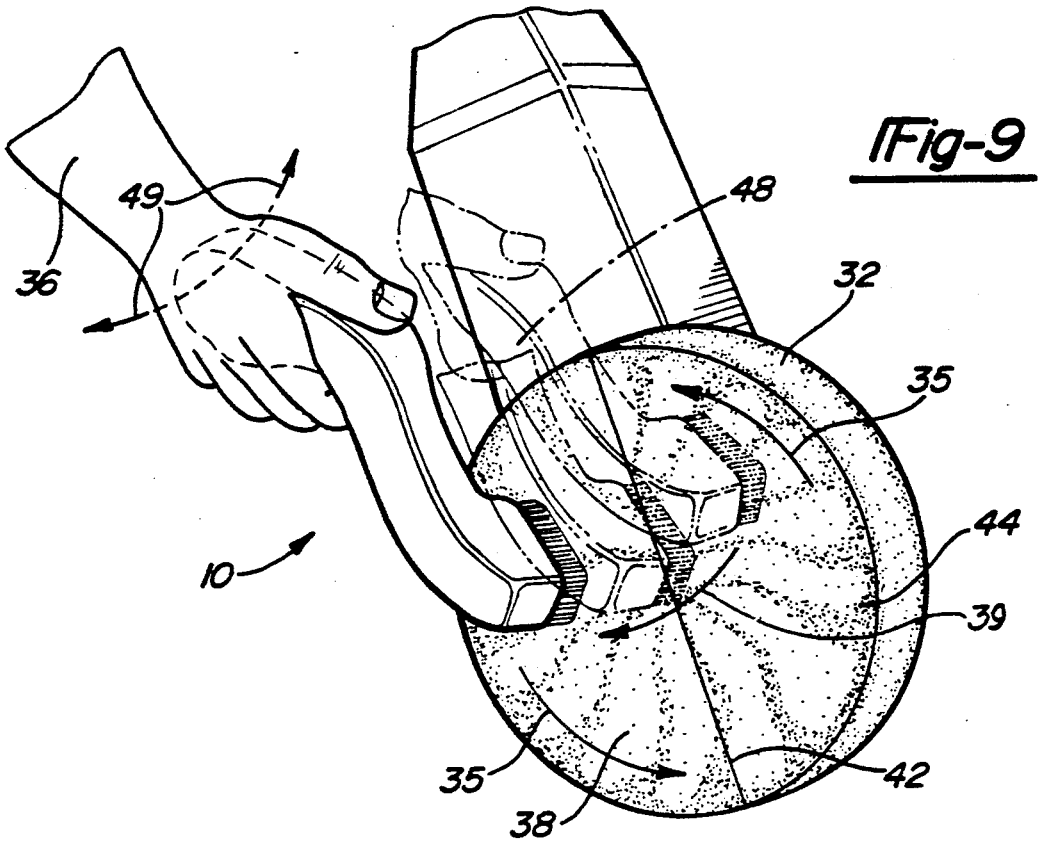
FIG. 9 is an overall perspective view of the reconditioning tool of the present invention as used in reconditioning of a buffing pad in accordance with the teachings of the present invention.

Referring to FIGS. 8 and 9, the rotary faced buffing pad 32, being reconditioned with a straight-handled wire brush prior art tool 34, as shown in FIG. 8, and the ergonomically configured tool 10 of the present invention is shown in FIG. 9 for comparison in this working environment. An analysis of the reactions by the respective tools demonstrates the advantages of the present invention over the prior art.

Referring to FIG. 8, the straight-handled brush 34 is held by an operator in one hand 36 with the rotary tool in the other hand (not shown) in the manner set forth above. The operator engages a first semi-circular portion 38 of the buffing pad 32 and moves the brush radially toward the center of the pad thereby removing undesirable compounds from the pad 32.

Typically, during at least some portion of this reconditioning process the operator will either over shoot or will be pulled onto the second semi-circular portion 44 of the pad 32. As a result, the straight-handled tool 34 has a tendency to uncontrollably jam in a backward direction as indicated in phantom at 46 and by arrow 37. Because the nature of the force being directly toward the wrist (see arrow 47) of the user, the wrist of the user is unable to overcome or control the force since the wrist cannot move directly toward the arm. Thus, such prior art methods could cause injury to the wrist of the user or any other parts of the body which may be in the way of the moving brush handle. In this manner the likelihood of potential injury to the user is increased.

Referring to FIG. 9, the ergonomically configured reconditioning tool 10 of the present invention is shown in its operational environment. The operator again holds the tool in a first hand and holds the rotary tool by engaging the first semi-circular portion 38 of the pad 32. Similarly, during reconditioning this tool 10 is moved from the first side of the pad toward the second side of the pad for reconditioning. During reconditioning of the pad the engagement portion will invariably travel from the first semi-circular portion 38, across the center line 42 of the pad 32, and onto the second semi-circular portion 44.

At this point, a benefit of the present invention is demonstrable. As a result of the non-amenable force created, the tool 10 will, rather than jam backwards, return to the first semi-circular portion 38 such as shown in phantom at 48 and by arrow 39 in a controlled rotational manner less hostile to operator 36. The present invention provides controlled rotational movement which takes advantage of the wrist's natural movement (see arrows 49) to help control and distribute forces in a manner less hostile to the operator.

While the above description constitutes the preferred embodiment of the present invention, it would be appreciated that the invention is susceptible to modification, variation and change without departing from the proper scope and fair meaning of the accompanying claims.

What is claimed is:

1. An ergonomically effective hand held tool for controlled reconditioning of a rotary faced buffing pad, said rotary faced buffing pad being rotated in a first direction and having a first semi-circular side amenable to controlled engagement by a reconditioning tool and a second semi-circular side not amenable to engagement by a reconditioning tool, said tool providing for controlled engagement of said second semi-circular portion which is non-hostile to the user of the tool, said tool comprising; a handle portion having a desired thickness when viewed in side elevation and defining a central plane, and a reconditioning portion having a desired thickness when viewed in side elevation and defining a central plane and a reconditioning element extending therefrom for reconditioning said pad by engagement therewith, and said reconditioning portion central plane being substantially coplanar with said handle portion central plane; a means for interconnecting said handle portion with said reconditioning portion in such a manner that the rotational moment transferred from the engagement surface by said reconditioning element of said reconditioning portion with the second semi-circular side of said rotating buffing pad to the user holding said handle is reduced versus a straight handle tool such that the user can controllably move said portions of said reconditioning element portion back onto the first semi-circular side wherein said reconditioning element is in a plane lower than and generally parallel with said central plane encompassing said handle portion and said reconditioning portion.

2. The tool of claim 1 wherein said reconditioning element is of a width less than a radii of the pad.

3. The tool of claim 1 wherein said handle portion includes a rear finger notch portion and a thumb rest portion for facilitating proper positioning of the tool in the hand of a user.

4. An ergonomically effective hand held tool for controlled reconditioning of a rotary faced buffing pad, said rotary faced buffing pad rotated by a hand held rotary tool held by an operator in a first hand such that the rotary faced buffing pad faces away from the operator, the rotary faced buffing pad rotating in a first direction with respect to the operator and having a first semi-circular portion amenable to controlled engagement by a reconditioning tool and a second semi-circular portion not amenable to engagement by a reconditioning tool, said tool comprising:

a handle portion, a reconditioning element portion, and a shaft portion interconnecting said handle portion and said reconditioning element portion along a longitudinal axis of the shaft portion; said handle, reconditioning element, and shaft portions all having a desired thickness and all portions defining a central plane when viewed in side elevation; said handle portion being disposed at a first angular direction with respect to said longitudinal axis, and said reconditioning element portion being disposed in a second angular direction opposite to said first angular direction; said handle portion, shaft portion and reconditioning element portion being substantially coplanar on said central plane; said reconditioning element portion including a reconditioning element extending therefrom in a second direction substantially perpendicular to said central plane and defining an engagement surface which is in a second plane and substantiall parallel to said central plane with said engagement surface for engagement with a buffing pad for reconditioning thereof, whereby the rotational moment transferred from the engagement surface to the user through the handle is reduced versus a straight handle tool for allowing improved control of the tool and said tool provides for engagement of said buffing pad on said first semi-circular portion thereof and provides for controlled movement of said reconditioning element back to said first semi-circular portion of said rotary faced buffing pad upon movement of said reconditioning element onto said second semi-circular portion of said rotary faced buffing pad.

5. The tool of claim 4 wherein said reconditioning element further comprises bristles for engaging the buffing pad surfaces, thereby effectively removing excess compounds from said pad surfaces.

6. The tool of claim 4 wherein said reconditioning element is positionally located on a plane lower than that of said handle portion to provide for usage by the operator without contact of the operator's hand with the buffing pad.

7. The tool of claim 4 wherein said reconditioning element for engaging the surface of said pad is of a width less than a radii of the pad.

8. The tool of claim 4 wherein said handle portion includes a rear finger notch and a thumb resting portion for facilitating proper positioning of said tool in the hand for a user.

9. The tool of claim 4 wherein said first angular direction is approximately 95 to 140 degrees and said second angular direction is approximately 15 to 60 degrees.

* * * * *